US008556665B2

(12) United States Patent
Schuppli

(10) Patent No.: US 8,556,665 B2
(45) Date of Patent: Oct. 15, 2013

(54) ELECTRICALLY CONTACTING AN ELECTRICAL COMPONENT

(75) Inventor: Rudolf Schuppli, Bad Zurzach (CH)

(73) Assignee: Bombardier Transportation GmbH, Berlin (DE)

( * ) Notice: Subject to any disclaimer, the term of this patent is extended or adjusted under 35 U.S.C. 154(b) by 42 days.

(21) Appl. No.: 13/496,370

(22) PCT Filed: Aug. 27, 2010

(86) PCT No.: PCT/EP2010/005337
§ 371 (c)(1),
(2), (4) Date: Mar. 15, 2012

(87) PCT Pub. No.: WO2011/032643
PCT Pub. Date: Mar. 24, 2011

(65) Prior Publication Data

US 2012/0178280 A1 Jul. 12, 2012

(30) Foreign Application Priority Data

Sep. 18, 2009 (DE) ..... 10 2009 041 894

(51) Int. Cl.
*H01R 4/38* (2006.01)

(52) U.S. Cl.
USPC ..... 439/765

(58) Field of Classification Search
USPC ..... 439/709, 754, 756–758, 765
See application file for complete search history.

(56) References Cited

U.S. PATENT DOCUMENTS

| | | | | |
|---|---|---|---|---|
| 2,786,162 | A * | 3/1957 | Ballou | 361/634 |
| 3,212,046 | A * | 10/1965 | Abel et al. | 439/502 |
| 3,728,656 | A * | 4/1973 | Neuber | 336/147 |
| 3,816,820 | A | 6/1974 | Stanaitis | |
| 3,831,129 | A * | 8/1974 | Frey | 439/513 |
| 3,862,458 | A | 1/1975 | Stanaitis | |
| 3,904,266 | A * | 9/1975 | Fitzpatrick | 439/570 |
| 4,273,408 | A * | 6/1981 | Orr | 439/737 |
| 4,345,806 | A * | 8/1982 | McHenney | 439/510 |
| 4,630,882 | A * | 12/1986 | Naylor et al. | 439/444 |
| 4,924,213 | A * | 5/1990 | Decho et al. | 340/653 |
| 5,030,797 | A * | 7/1991 | Logstrup | 174/68.1 |
| 5,037,333 | A * | 8/1991 | Baubles | 439/722 |
| 5,116,246 | A * | 5/1992 | Perry et al. | 439/620.34 |
| 5,203,724 | A * | 4/1993 | Casey | 439/792 |
| 5,594,403 | A * | 1/1997 | Taga et al. | 337/186 |

(Continued)

FOREIGN PATENT DOCUMENTS

| | | |
|---|---|---|
| DE | 3410843 A1 | 9/1985 |
| DE | 4022086 A1 | 2/1991 |

(Continued)

*Primary Examiner* — Ross Gushi

(74) *Attorney, Agent, or Firm* — The Webb Law Firm

(57) ABSTRACT

Disclosed is an arrangement for electrically contacting a component, in particular a capacitor for a power converter of a rail vehicle, wherein the component includes a protruding pin for applying and/or positioning parts in order to produce the electrical contact. The arrangement a first element which has a through-bore extending in a longitudinal direction therethrough for inserting the pin, a second element which has a through-bore extending in a longitudinal direction therethrough for inserting the pin, and a contact plate of an electrically conductive material, which comprises a contact plate end region. The contact plate end region has a slot extending from a free end into the contact plate end region and the width of the slot is sufficiently large to accommodate the pin.

10 Claims, 6 Drawing Sheets

(56) References Cited

U.S. PATENT DOCUMENTS

| | | | | |
|---|---|---|---|---|
| 5,595,505 | A * | 1/1997 | Duke et al. | 439/630 |
| 5,900,332 | A * | 5/1999 | Marukawa et al. | 429/158 |
| 6,186,831 | B1 * | 2/2001 | Tsai | 439/627 |
| 6,224,430 | B1 * | 5/2001 | Kusuda et al. | 439/709 |
| 6,916,213 | B2 * | 7/2005 | Nyblin et al. | 439/709 |
| 7,270,576 | B2 * | 9/2007 | Kim et al. | 439/627 |
| 7,438,603 | B1 * | 10/2008 | Lewis | 439/709 |
| 7,972,185 | B2 * | 7/2011 | Kim | 439/754 |
| 8,133,607 | B1 * | 3/2012 | Chen et al. | 429/158 |
| 8,178,234 | B2 * | 5/2012 | Fukuoka et al. | 429/160 |
| 2004/0053126 | A1 * | 3/2004 | Hirano et al. | 429/153 |
| 2005/0079408 | A1 * | 4/2005 | Hirano | 429/82 |
| 2008/0063932 | A1 * | 3/2008 | Ishizu et al. | 429/129 |
| 2010/0233915 | A1 * | 9/2010 | Kim | 439/754 |
| 2011/0092111 | A1 * | 4/2011 | Tsuchiya et al. | 439/765 |
| 2012/0178280 | A1 * | 7/2012 | Schuppli | 439/359 |

FOREIGN PATENT DOCUMENTS

| | | | |
|---|---|---|---|
| DE | 4008417 | A1 | 9/1991 |
| DE | 4444859 | A1 | 6/1996 |
| DE | 10057140 | A1 | 6/2002 |
| DE | 102007020295 | A1 | 11/2008 |
| EP | 0450122 | A1 | 10/1991 |
| FR | 2201551 | A1 | 4/1974 |

* cited by examiner

ELECTRICALLY CONTACTING AN ELECTRICAL COMPONENT

BACKGROUND OF THE INVENTION

1. Field of the Invention

The invention relates to an arrangement for electrically contacting an electrical component, in particular, a capacitor for a power converter of a rail vehicle. The electrical component has a protruding pin for applying and/or positioning parts of the arrangement in order to produce the electrical contact. The invention further relates to a corresponding method for electrically contacting an electrical component.

2. Description of Related Art

Capacitors have been used for several years to store electrical energy, in particular the braking energy of rail vehicles. The energy stored in the capacitors can be used, in particular, for the next start-up process or acceleration process. Capacitors, however, are also used as filter capacitors in electrical circuits included in power inverters to convert direct current and to operate the traction motors of a rail vehicle. In addition, smoothing capacitors can be used in the circuits for smoothing the direct voltage on the direct voltage side of the power inverter. In these applications in particular, capacitors are frequently combined into assemblies having a plurality of capacitors.

In one usual configuration, the housing of the capacitor is cylindrical and is connected to one of the two electrical potentials of the capacitor or the plurality of the capacitors arranged in the housing. The other potential is connected to a pin-shaped contact on the front of the housing.

The invention relates, in particular, to those types of applications or contacting the capacitors in such applications. However, the invention is also suitable for other electrical components having a protruding pin constructed, in particular, as a pin-shaped contact. The pin in particular serves to apply and/or position parts used for producing an electrical contact.

In particular because the material has very good conductivity and parts are relatively easy to manufacture from the material, copper material is frequently used for electrical contacts. The term copper material describes a material with a very high proportion (e.g., more than 50%) of copper or that is even virtually pure copper.

In particular for the aforementioned applications for rail vehicles, the capacitors may be charged and discharged at high currents of, for example, more than 100 A. For producing an electrical contact, tabs made of copper sheet are usually used. One possible embodiment of the design of the end region of one such copper sheet provides a slot extending from the free end into the end region where the two blades created in this manner accommodate the contact pin of the electrical component between them so that the contact pin is located in the slot. For example, the end region of the contact sheet can then be screwed tight by means of a nut screwed onto the contact pin equipped with an external thread. However, a disadvantage of this is that the copper flows, i.e., it changes shape, under mechanical pressure over time. For this reason, the two blades may migrate outward impairing the electrical contact with the contact pin. There exists the risk of a loss of contact material.

If the copper tab, i.e., the copper sheet end region, has a hole through which the contact pin of the component extends, migration of the material can be prevented in one direction. However, such copper tabs are difficult to assemble. They cannot be moved toward the contact pin from the side but rather must be placed over the contact pin from above.

It is one object of this invention to specify an arrangement and a method of the type cited at the beginning that permit simple assembly and provide a permanently reliable electrical contact.

SUMMARY OF THE INVENTION

To allow for simple assembly, it is proposed to use the slotted configuration of the contact sheet end region mentioned above. With the help of two elements of the arrangement, each having one through-hole for the pin of the component, the blades are, however, prevented from moving out of the intended position due to material flow or by any other manner. For this purpose, at least one of the two elements provides a contact surface running parallel to the longitudinal axis of the pin and making contact to one edge of the contact sheet end region. The blade is held in position by the contact surface. One contact surface is sufficient if the contact sheet end is formed so that only a narrow blade is provided and the contact sheet on the facing side of the slot is implemented to be stable, e.g., part of a contact rail that also is shaped at an angle with respect to the contact sheet end region and is thus mechanically fastened to other parts. If, however, two blades are provided that are located on the two sides of the slot in the contact sheet end region, another contact surface is preferably formed by at least one of the elements provided with the through-hole so that the contact sheet end region is accommodated with its blades between the contact surfaces that face one another. In this way, the pin of the electrical component in the assembled position extends through the slot, approximately in the center of the two contact surfaces.

In particular, the following is proposed: an arrangement for electrically contacting an electrical component, in particular, a capacitor for a power converter of a rail vehicle wherein the electrical component has a protruding pin for applying and/or positioning parts of the arrangement in order to produce the electrical contact, and wherein the arrangement has the following:

a) a first element having a first through-hole extending in a longitudinal direction through the element for inserting the pin, b) a second element having a second through-hole extending in a longitudinal direction through the element for inserting the pin, c) a contact sheet, made of an electrically conducting material, that has a contact sheet end region used to produce the electrical contact with the electrical component wherein the contact sheet end region has a slot extending from one free end into the contact sheet end region, this slot being wide enough to accommodate the pin, d) a fastening element, wherein the first element and/or the second element consists of an electrically conducting material; wherein the first element has a first surface and the second element has a second surface; wherein the first element and/or the second element has at least one region protruding parallel to the longitudinal direction, this region having a contact surface facing the through-hole; and wherein, when the arrangement is assembled:

the contact sheet end region makes contact with one side on the first surface and with a second side opposite the first side on the second surface such that the contact sheet end region is accommodated in a sandwich-like fashion between the first and second surfaces;

the contact sheet end region with a surface area running between the first side and the second side makes contact with the contact surface of the first and/or second element;

the pin extends perpendicular to the first surface and the second surface through the first element, the slot of the contact sheet end region and the second element;

the fastening element is supported on the pin and presses the first and the second surfaces against the contact sheet end region.

The pin is cylindrical in particular and preferably constructed as a contact pin of electrically conducting material. The electrical contact between the contact sheet end region and the electrical component must not, however, even in this case, be produced as an electrical contact alone between the contact sheet end region and the pin. Rather, in particular the first element of the arrangement located farther from the free end of the pin can be, used, this element consisting of electrically conducting material, e.g., preferably copper material. In this case, the first element can produce the contact with the contact pin or with a pressing surface from which the pin protrudes, this surface being located behind the first element from the view of the free end of the pin. This pressing surface is constructed from an electrically conducting material of the electrical component. The first element can, for this reason, be sized parallel to the longitudinal axis of the pin such that manufacturing tolerances and/or level differences can be offset by suitably selected dimensions for the first element.

As already mentioned, the contact sheet preferably consists of a copper material, in particular of copper with a degree of purity customary for electrical components.

The slot in the contact sheet end region need not have a width chosen precisely with regard to the width, in particular the diameter, of the pin. Rather, the width of the slot may be somewhat larger. When pressing the first surface and the second surface against the facing sides of the contact sheet end region, the material of the contact sheet end region, in particular if it is copper material, may flow and make contact with the pin in this way.

With regard to the fastening element, it is preferably a nut screwed onto an external thread of the pin and thus presses the first element and the second element against one another in the direction of the longitudinal axis of the pin and, in this way, ensures electrical contact between the contact sheet end region and at least one of the elements, namely the electrically conducting element. If necessary, the nut can also be secured by means of a lock nut.

The first surface of the first element making contact with the one side of the contact sheet end region and the second surface of the second element making contact with the opposite side of the contact sheet end region are preferably flat surfaces running parallel to one another. Accordingly, the contact sheet end region also having parallel surfaces on the opposite sides when the arrangement is assembled makes contact over a large area.

Preferably, the first element located farther away from the free end of the pin is made of copper material and the second element located nearer to the free end of the pin is made of steel. As the second element in this case need not be made of particularly good electrically conducting material, steel is sufficient. Steel also has advantages with regard to its hardness. The fastening element can be substantially narrower than the second element so that the contact surface between the fastening element and the second element is relatively small.

Preferably, the first element and the second element are circular in cross-section, i.e., perpendicular to the longitudinal axis of the pin. Their surfaces, located farther away in the longitudinal direction of the pin from the point of view of the contact sheet end region, are thus preferably circular areas with a central through-hole through which the pin extends.

The first element and/or the second element preferably have two areas protruding parallel to the longitudinal direction, each of these areas having a contact surface facing the through-hole and opposite one another from the point of view of the through-hole. When the arrangement is assembled, the contact sheet end region lies between the contact surfaces of the first and/or the second element facing one another and is accommodated between them. It was previously mentioned that this development is preferred for the case that the contact sheet end region has two blades separated by the slot.

Furthermore, a method for electrically contacting an electrical component is proposed, in particular a capacitor for a power inverter of a rail vehicle, wherein the electrical component has a protruding pin and wherein:

a) a first element having a first through-hole that extends in a longitudinal direction through the element and that is slipped over the pin so that the pin extends through the second through-hole;

b) a second element having a second through-hole that extends in a longitudinal direction through the element and that is slipped over the pin so that the pin extends through the first through-hole;

c) a contact sheet end region of a contact sheet consisting of an electrically conducting material wherein the contact sheet end region has a slot extending from one free end into the contact sheet end region extends between the first element and the second element or in contact with the first element before the second element, the contact sheet end region is slipped over the pin at an end position so that the contact sheet end region makes contact with a first side to a first surface of the first element and with a second side opposite the first side to a second surface of the second element so that the contact sheet end region is accommodated in a sandwich-like fashion between the first and second surfaces wherein the pin extends perpendicular to the first surface and the second surface through the first element, the slot of the contact sheet end region and the second element;

d) a fastening element is supported on the pin so that the first and the second surface are pressed against the contact sheet end region;

wherein the first element and/or the second element consist of an electrically conducting material and wherein the first element and/or the second element has at least one region protruding in parallel with the longitudinal direction, this region having a contact surface facing the through-hole, so that the contact sheet end region makes contact with a surface region running between the first side and the second side on the contact surface of the first and/or second element.

Configurations for the method result from the description of the arrangement according to the invention.

BRIEF DESCRIPTION OF THE DRAWINGS

Exemplary embodiments are now described referencing the accompanying drawing. The individual figures of the drawing are not shown to scale.

DESCRIPTION OF THE PREFERRED EMBODIMENTS

Figure 1:
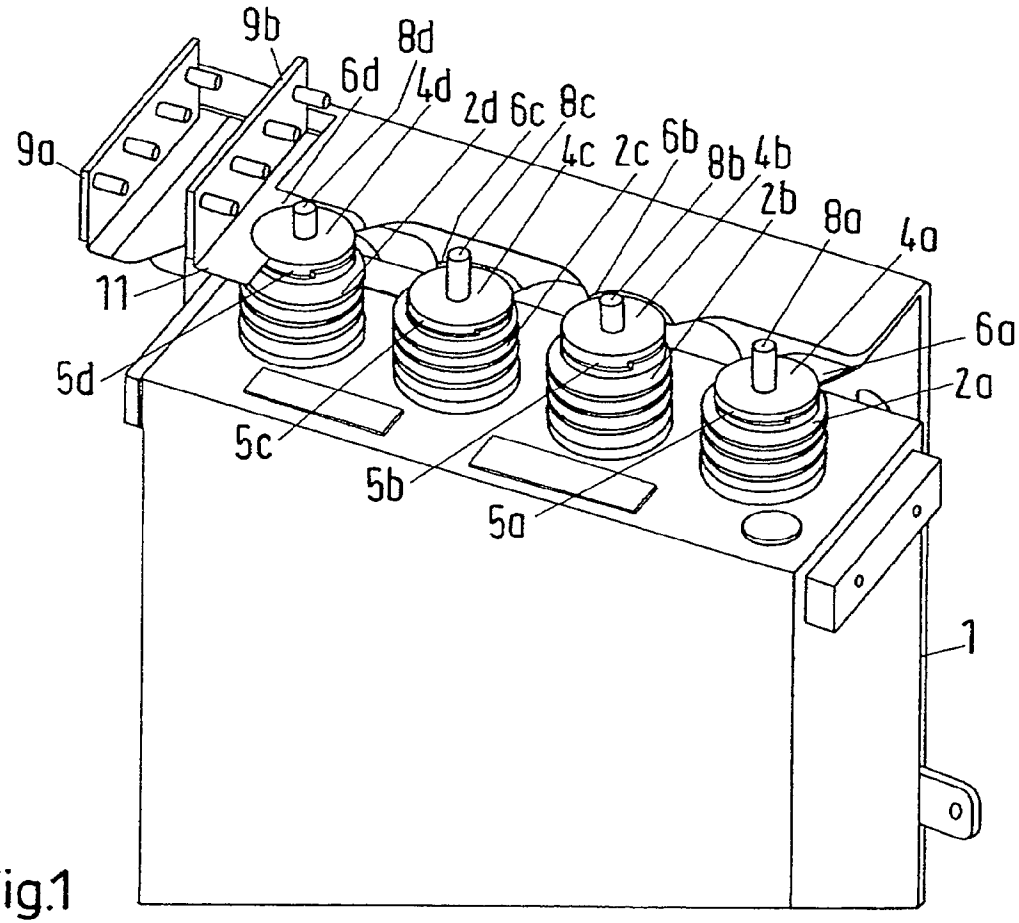
FIG. 1 shows a three-dimensional representation of an arrangement with four capacitors arranged next to one another, each capacitor having one contact pin protruding upward.

The block 1 shown in FIG. 1 has four capacitors, the upper end regions of each 2*a*, 2*b*, 2*c*, 2*d* being depicted. A contact pin 8 protrudes upward from each end region 2. Behind the block 1 can be seen an arrangement of two contact rails for electrically contacting the capacitors. In the area immediately behind the capacitors, the contact rails 9*a* (the lower contact rail) and 9*b* (the upper contact rail) are arranged above one another. In this arrangement, the upper contact rail 9*b* has two contact sheet end regions protruding forward in FIG. 1 in the direction of the upper area 2 of the capacitors. These contact sheet end regions are identified with the reference mark 6*b* for electrically contacting the upper area 2*b* using contact pin 8*b* and with the reference mark 8*d* for electrically contacting the upper area 2*d*. In this configuration, the contact sheet end region 6*b* is slotted and has two blades while the contact sheet end region 6*d*, while also being slotted, has only one blade and, instead of the second blade, has a wide area 11 that transitions by means of an angle into a connecting region jutting upward.

The lower rail 9*a* has two slotted contact sheet end regions 6*a*, 6*c*, provided with two blades for contacting the upper areas 2*a* and 2*c*.

Two elements 4, 5 of an arrangement for contacting the upper areas 2 are slipped onto each of the contact pins 8. However, the lower first elements 5 are designed to be different heights in accordance with the differing height levels for contacting by way of the contact sheet end regions 6 of the rails 9. The lower elements 5*a* and 5*c* of the upper areas 2*a*, 2*c* are, measured in the longitudinal direction of the pins 8, smaller than the heights of the lower first elements 5*b*, 5*d* of the upper areas 2*b*, 2*d*. In contrast to this, the upper, second elements 4 can be of identical design for all capacitors.

Not shown in FIG. 1 are the nuts screwed onto the contact pins 8 to press the elements 4, 5 against one another and to press against the contact surfaces of the upper areas 2 so that the contact sheet end regions 6 arranged between the elements 4, 5 are pressed together like a sandwich.

Figure 2:
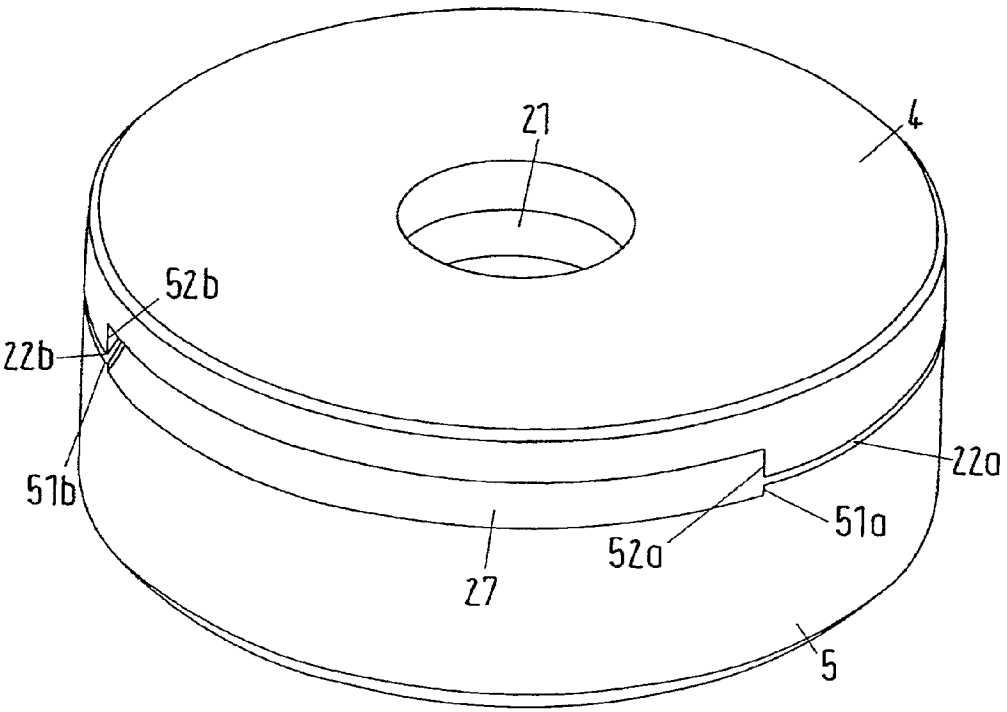
FIG. 2 depicts an essentially cylindrical, disk-like arrangement with one central through-hole, the arrangement being formed from a first and a second element wherein a gap extending perpendicular to the longitudinal axis of the through-hole between the first and second element can be seen.

FIG. 2 shows a pair consisting of one of the first elements 5 and one of the second elements 4. The through-hole 21 can be seen on the upper, second element 4. The lower, first element 5 also has such a through-hole having an inner diameter that is slightly larger than the outer diameter of the contact pins 8. Gaps 22*a*, 22*b* running horizontally left and right can be seen between the first element 5 and the second element 4. These gaps 22 could be closed if there is no contact sheet end region between the first element 5 and the second element 4. The arrangement in FIG. 2, however, roughly shows the gaps 22 present if a contact sheet end region is present between the elements 4, 5 and the elements 4, 5 are not pressed against one another. The space 27, delimited laterally by the protruding areas 51 and 52 and serving to accommodate the contact sheet end region, is located between the gaps 22.

Figure 3:
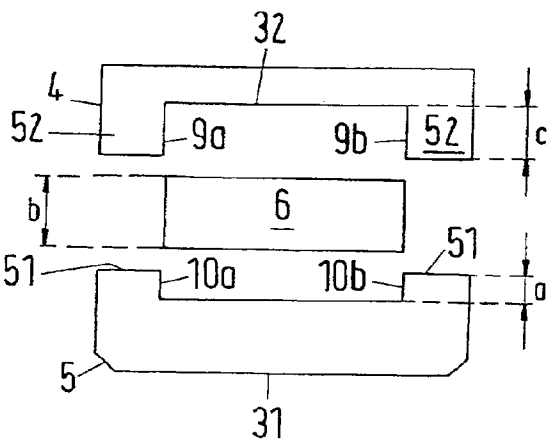
FIG. 3 illustrates schematically a side view of the elements shown in FIG. 2 wherein the contact sheet end region can be seen between the elements and wherein the three parts are illustrated in a type of exploded drawing.

The schematic representation in FIG. 3 shows a first element 5 (bottom) and a second element 4 (top). Between the elements 4, 5 is a contact sheet end region 6 in the exploded diagram. The slot of the end region 6 cannot be seen because this is a schematic diagram that can also be considered a front view.

The principle of the structure of the elements 4, 5 can be seen in FIG. 3. The first element 5 has two areas 51 protruding upward that each form part of the outer circumference of the element 5 around the outer radius. A free space is located between them that can also be considered a groove and is bordered on the bottom by a first surface 31. The inside surfaces of the protruding areas 51 are identified with the reference marks 10*a*, 10*b*. They form contact surfaces for the contact sheet end region 6 when assembled. The width of the contact sheet end region 6 is slightly smaller than the spacing of the contact surfaces 10*a*, 10*b*.

If elements 4, 5 are assembled, i.e., pressed together in the vertical direction shown in FIG. 3, the contact sheet end region 6 will come into contact at the top with the second surface 32 and at the bottom with the first surface 31. This is possible because the thickness b of the contact sheet end region 6 is greater than the sum of the heights of the contact surfaces 10 and 9. The height of the contact surfaces 10 is marked with a. The height of the contact surfaces 9 is marked with c.

Figure 4:
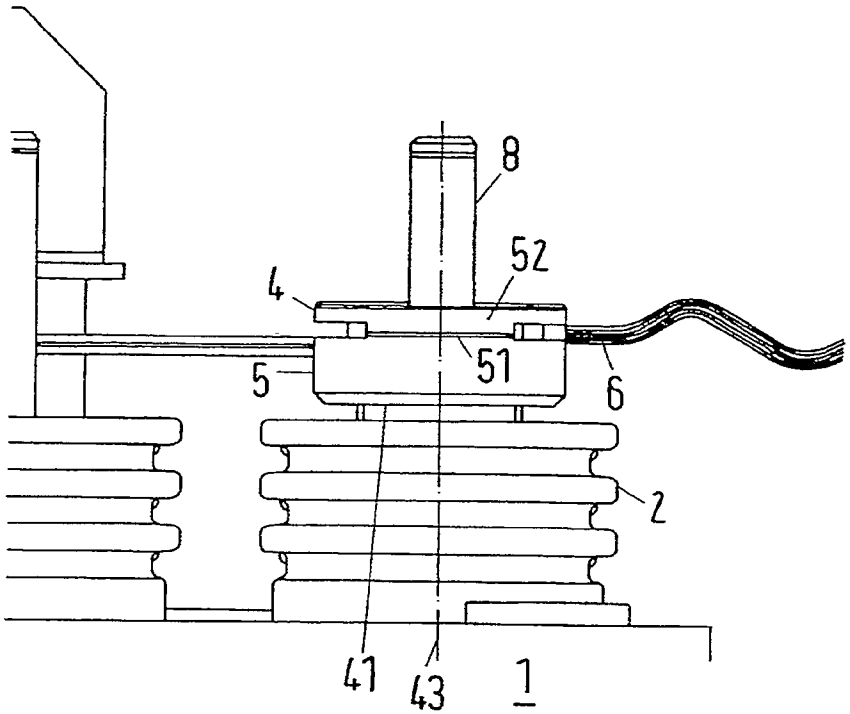
FIG. 4 is a side view of the upper area of one of the capacitors shown in FIG. 1 making electrical contact by way of a contact sheet.

In the side view of FIG. 4, for example, one of the top areas 2 of the capacitors shown in FIG. 1 can be seen. This top area has a contact surface 41 extending vertically with respect to the longitudinal axis 43 of the contact pin 8 whose top, free end can be seen. The nut used to press the arrangement of the elements 4, 5 to the contact surface 41 is again not shown. The bottom of the lower, first element 5 makes direct contact with the contact surface 41. The contact sheet end region 6 is located between the upper, second element 4 and the lower element 5 and extends in a groove as shown schematically in FIG. 3. In this respect, the view toward the areas 51, 52 of the elements 5, 4 that are in the front in the figure and that protrude upward or downward, respectively, can be seen in FIG. 4. The contact sheet end region 6 continues to the right into an area of the contact sheet that runs in a serpentine course in the cross-section shown.

Figure 5:
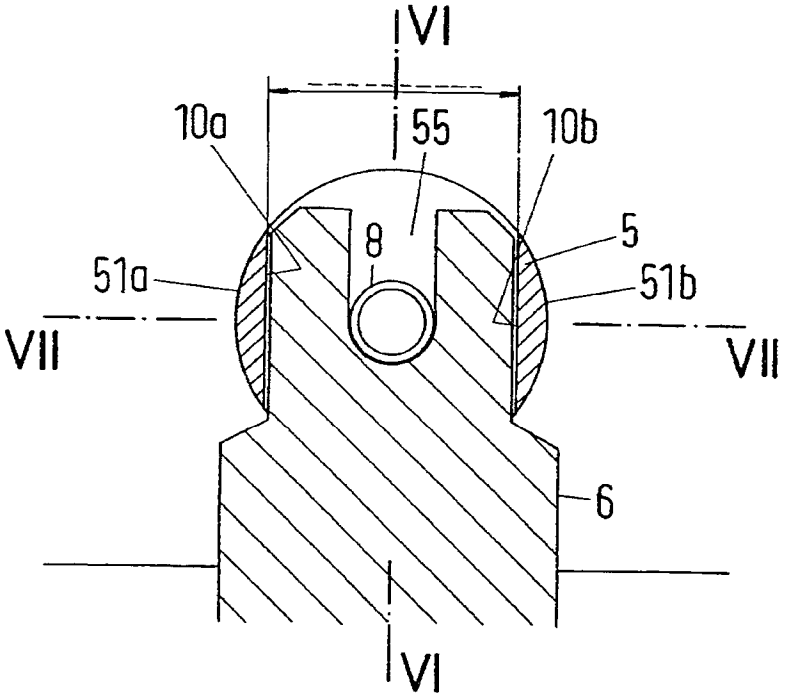
FIG. 5 depicts a sectional view of one particularly preferred embodiment of the arrangement in the invention for contacting an electrical component using a contact pin wherein the plane of the figure runs perpendicular to the longitudinal axis of the contact pin and in the plane of the contact sheet end region and of the first element.

FIG. 5 shows a section through the arrangement shown in FIG. 4 wherein the section runs perpendicular to the longitudinal axis 43 of the contact pin 8 at the level of the protrusions 51. In FIG. 5, the protrusion shown on the left is identified with 51*a* and the protrusion shown on the right is identified with 51*b*. The contact surfaces 10*a*, 10*b* run in the illustration of FIG. 5 from top to bottom in the direction of the longitudinal axis of the slot 55 that extends from the free end of the contact sheet end region 6 into its interior. The contact pin 8 is located on the rounded closed end of the slot 55 and is in virtually complete contact with the closed end. The spacing between the contact surfaces 10*a*, 10*b* is marked using a double-headed arrow (at the top of FIG. 5).

The figure shows that the contact sheet end region 6, where it is slotted, has a smaller width than in the area at the bottom of FIG. 5.

Figure 6:
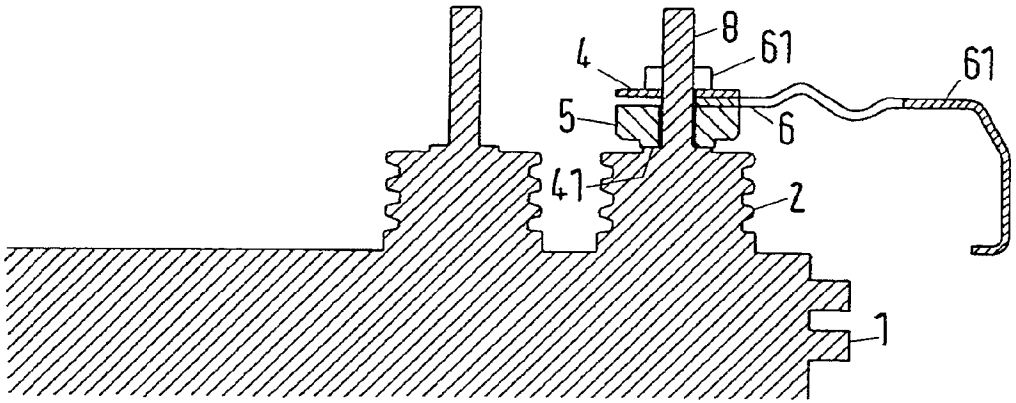
FIG. 6 illustrates a sectional view of an arrangement for contacting an electrical component with a contact pin wherein, in a manner similar to that of FIG. 1, upper areas of capacitors arranged next to one another can be seen and, of these, one capacitor is electrically contacted and wherein the section with regard to the capacitor shown on the right has the section line marked with VI-VI in FIG. 5.
Figure 7:
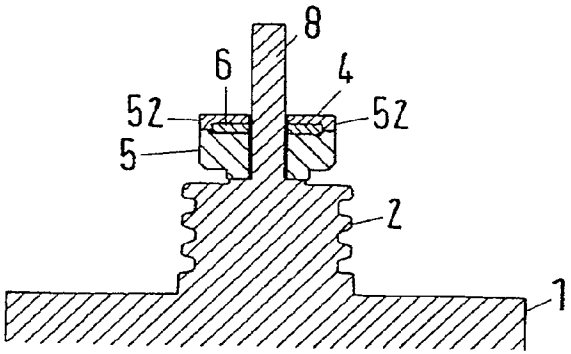
FIG. 7 is a section similar to that of FIG. 6 wherein, however, the sectional plane contains the section line marked with VII-VII in FIG. 5.

The line running horizontally in FIG. 5, identified using VII-VII, indicates the section plane of FIG. 7. The line VI-VI running vertically indicates the section plane of FIG. 6.

FIG. 6 shows the entire contact sheet 64 in cross section with its contact sheet end 6 located between the top, second element 4 and the bottom, first element 5. In addition, the nut 61, which can be seen above the second element 4, presses the elements 4, 5 against the contact sheet end region 6 and, the same time, the bottom surface of the first, lower element 5 against the contact surface 41.

From right to left as seen along of the course of the contact sheet with its contact sheet end region 6, the contact sheet end region shown in FIG. 6 ends at the contact pin 8 because the slot in the contact sheet end region 6 starts there and runs to the left. The slot is identified in FIG. 5 with the reference mark 55.

In the other section drawing of FIG. 7, it can be seen on the other hand that the contact sheet end region 6 extends to the right and left beside the contact pin 8. The contact pin 8 inside the slot is located between these recognizable areas of the contact sheet end region 6. The illustration of FIG. 7 corresponds to the exploded drawing in FIG. 3 with regard to the elements 5, 4 and with regard to the contact sheet end region 6 wherein, however, in FIG. 7, the through-holes through the elements 4, 5 and the contact pin 8 located within can also be seen.

Figure 8:
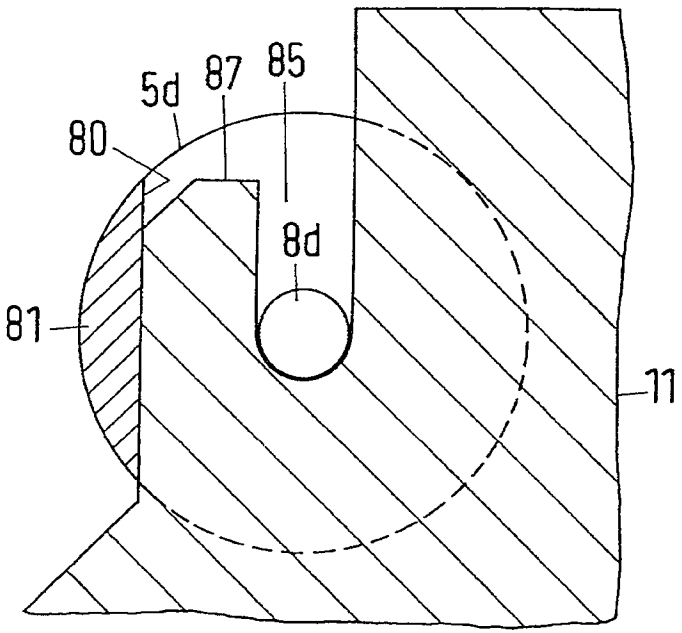
FIG. 8 shows one preferred exemplary embodiment of another type of the arrangement of the invention for contacting an electrical component wherein the figure shows a horizontal section similar to that of FIG. 5 wherein, however, the contact sheet end region has only one blade.

FIG. 8 shows, similar to the illustration of FIG. 5, a horizontal section through the arrangement for contacting of the upper area 2*d* of the capacitors shown at the left in FIG. 1. In this, the contact sheet to the right in FIG. 8 has the wide area 11 and a single blade 87 to the left. A slot 85 is formed between the area 11 and the blade 87 with the contact pin 8*d* located on the rounded closed end of the slot.

A contact surface 80 for contacting the blade 87 is formed by the upward protruding area 81 of the lower, first element 5*d*. In FIG. 5, the protruding area 51*a* corresponds to the protruding area 81. For the protruding area 51*b* shown on the right in FIG. 5 there is no corresponding area in the design shown in FIG. 8. Rather, the upper surface of the first element 5*d* whose outlines are shown using dashed lines below the contact sheet is flat to the right of the contact surface so that the contact sheet can make contact there.

In the design shown in FIG. 8, the upper, second element that is not shown also has only one contact surface for contacting the blade 87 and the lower surface of the second element is also designed to be otherwise flat corresponding to the upper surface of the first element 5*d* and extends perpendicular to the longitudinal axis of the contact pin 8*d*.

The arrangement for contacting an electrical component, in particular the upper part 2 of a capacitor, is assembled as follows for example. First, the first element 5 is slipped onto the contact pin 8 in particular so that its lower surface makes contact with the contact surface 41 of the upper part 2. Then, either contact sheet end region is inserted into the groove between the contact surfaces 10 until the closed end of the groove touches the contact pin 8. As an alternative, first the second element 4 is slipped over the contact pin 8 and then the contact sheet end region 6 is inserted into the groove between the contact surfaces 10 or between the contact surfaces 9 until the closed end makes contact with the contact pin 8.

Finally, the nut 61 is screwed in place (FIG. 6) so that the elements 4, 5 are pressed together against the contact sheet end region 6 and also the lower, first element 5 is pressed against the contact surface 41.

Since, as shown in FIG. 5, the blades on both sides of the slot 55 cannot migrate laterally to the outside, the electrical contact with the contact pin is permanently assured.

In the design of FIG. 8, it is not possible for the blade 87 to migrate because the blade is located between the contact pin 8*d* and the contact surface 80. The large area 11 can also not migrate because it is basically more stable and transitions into the connection area of the rails by way of the kinked form and, for example, this connection area is mechanically fastened.

The invention claimed is:

1. An arrangement for electrically contacting an electrical component, in particular, a capacitor for a power converter of a rail vehicle wherein the electrical component has a protruding pin for applying and/or positioning parts of the arrangement in order to produce the electrical contact, and wherein the arrangement comprises:

a) a first element having a first through-hole extending in a longitudinal direction through the element for inserting the pin, b) a second element having a second through-hole extending in a longitudinal direction through the element for inserting the pin, c) a contact sheet, made of an electrically conducting material, that has a contact sheet end region used to produce the electrical contact with the electrical component wherein the contact sheet end region has a slot extending from one free end into the contact sheet end region, this slot being wide enough to accommodate the pin, and d) a fastening element;

wherein the first element and/or the second element is formed of an electrically conducting material; wherein the first element has a first surface and the second element has a second surface; wherein the first element and/or the second element has at least one region protruding parallel to the longitudinal direction, this region having a contact surface facing the through-hole; and wherein, when the arrangement is assembled:

the contact sheet end region makes contact with one side to the first surface and a second side opposite the first side makes contact to the second surface such that the contact sheet end region is accommodated in a sandwich-like fashion between the first and second surfaces;

the contact sheet end region makes contact with a surface region running between the first side and the second side with the contact surface of the first and/or second element;

the pin extends perpendicular to the first surface and the second surface through the first element, the slot of the contact sheet end region and the second element; and the fastening element is supported on the pin and presses the first and the second surfaces against the contact sheet end region.

2. The arrangement according to claim 1, wherein the first element and/or the second element have two regions protruding parallel to the longitudinal direction, each of these regions having a contact surface facing the through-hole and opposite one another from the point of view of the through-hole and, when the arrangement is assembled, the contact sheet end region is accommodated between the contact surfaces, facing one another, of the first and/or the second element and makes contact with the contact surfaces.

3. The arrangement according to claim 1, wherein the length of the protruding area measured parallel to the longitudinal direction of the pin or the sum of lengths of the protruding areas is smaller than the thickness of the contact sheet end region measured parallel to the longitudinal direction of the pin so that the contact sheet end region (6) is pressed by the fastening element against the first surface and against the second surface.

4. The arrangement according to claim 1 wherein the fastening element is a nut that is screwed onto the pin provided with an external thread.

5. The arrangement according to claim 1, wherein the contact sheet end region consists of copper material.

6. The arrangement according to claim 1, wherein the component has a pressing surface from which the pin extends and wherein the fastening element, when the arrangement is assembled, presses the first element, against the contact sheet end region and the second element against the pressing surface.

7. A method for electrically contacting an electrical component, in particular a capacitor for a power converter of a rail vehicle wherein the electrical component has a protruding pin and wherein:

a) a first element having a first through-hole extending in a longitudinal direction through the element is slipped onto the pin so that the pin extends through the first through-hole;

b) a second element having a second through-hole extending in a longitudinal direction through the element is slipped onto the pin so that the pin extends through the second through-hole;

c) a contact sheet end region of a contact sheet consisting of an electrically conducting material wherein the contact sheet end region has a slot extending from one free end into the contact sheet end region, extends between the first element and the second element or in contact with the first element before the second element, the contact sheet end region is slipped over the pin at an end position so that the contact sheet end region makes contact with a first side to a first surface of the first element and with a second side opposite the first side to a second surface of the second element so that the contact sheet end region is accommodated in a sandwich-like fashion between the first and second surfaces wherein the pin extends perpendicular to the first surface and the second surface through the first element, the slot of the contact sheet end region and the second element, and d) a fastening element is supported on the pin so that the first and the second surfaces are pressed against the contact sheet end region, wherein the first element and/or the second element consist is formed of an electrically conducting material and wherein the first element and/or the second element has at least one region protruding in parallel with the longitudinal direction, this region having a contact surface facing the through-hole, so that the contact sheet end region makes contact with a surface region running between the first side and the second side at the contact surface of the first and/or second element.

8. The method according to claim 7, wherein the first element and/or the second element has at least one region protruding parallel to the longitudinal direction, this region having contact surfaces facing the through-hole and opposite one another from the point of view of the through-hole and wherein the contact sheet end region is accommodated between the contact surfaces facing one another of the first and/or the second element and makes contact with the contact surfaces.

9. The method according to claim 7, wherein the fastening element is a nut that is screwed onto the pin provided with an external thread.

10. The method according to claim 7, wherein the component has a pressing surface from which the pin extends and wherein the fastening element presses the first element against the contact sheet end region and the second element against the pressing surface.

* * * * *

UNITED STATES PATENT AND TRADEMARK OFFICE

CERTIFICATE OF CORRECTION

PATENT NO. : 8,556,665 B2
APPLICATION NO. : 13/496370
DATED : October 15, 2013
INVENTOR(S) : Rudolf Schuppli It is certified that error appears in the above-identified patent and that said Letters Patent is hereby corrected as shown below:

In the Claims

Column 10, Line 13, Claim 7, after "element" delete "consist"

Signed and Sealed this
Twenty-fifth Day of February, 2014

Michelle K. Lee

Michelle K. Lee
*Deputy Director of the United States Patent and Trademark Office*